US005722511A

United States Patent [19]

Wakamiya

[11] Patent Number: 5,722,511

[45] Date of Patent: Mar. 3, 1998

[54] LIFTING VEHICLE AND METHOD OF OPERATING THE VEHICLE

[75] Inventor: Koji Wakamiya, Aichi-Ken, Japan

[73] Assignee: Bishamon Industries Corporation, Ontario, Calif.

[21] Appl. No.: 542,672

[22] Filed: Oct. 13, 1995

[30] Foreign Application Priority Data

Oct. 17, 1994 [JP] Japan ..... 6-250864

[51] Int. Cl.[6] ..... B66F 9/06

[52] U.S. Cl. ..... 187/231; 187/237

[58] Field of Search ..... 187/231, 232, 187/237, 233; 414/630, 631

[56] References Cited

U.S. PATENT DOCUMENTS 4,502,568 3/1985 Lebre ..... 187/231

*Primary Examiner*—Kenneth Noland
*Attorney, Agent, or Firm*—Antonio R. Durando

[57] ABSTRACT

A forklift is supported for movement by a pair of elongated wheeled members. The wheeled members are shiftable towards and away from one another to permit the handling of different types of loads. Each of the wheeled members has a rear wheel in the form of a caster as well as two front wheels. The front wheels of a wheeled member can be lowered and raised in such a manner that one of the front wheels is lifted from the ground as the other front wheel is moved down into contact with the ground. A first front wheel of each wheeled member is arranged to roll forwards and backwards while the second front wheel rolls sideways. During the transportation of loads from one location to another, the first front wheels are in contact with the ground. When the wheeled members are to be moved towards or away from one another, the second front wheels are brought into contact with the ground.

9 Claims, 3 Drawing Sheets

Fig. 4A
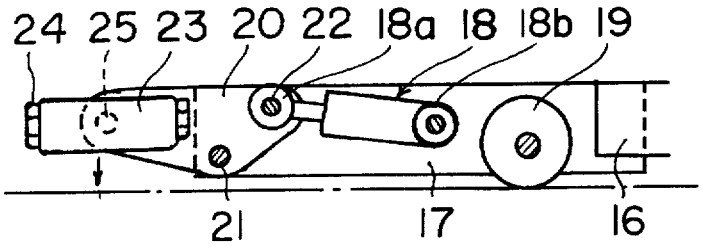
Fig. 4B
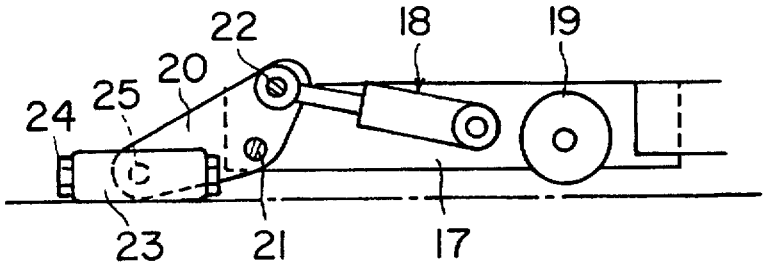
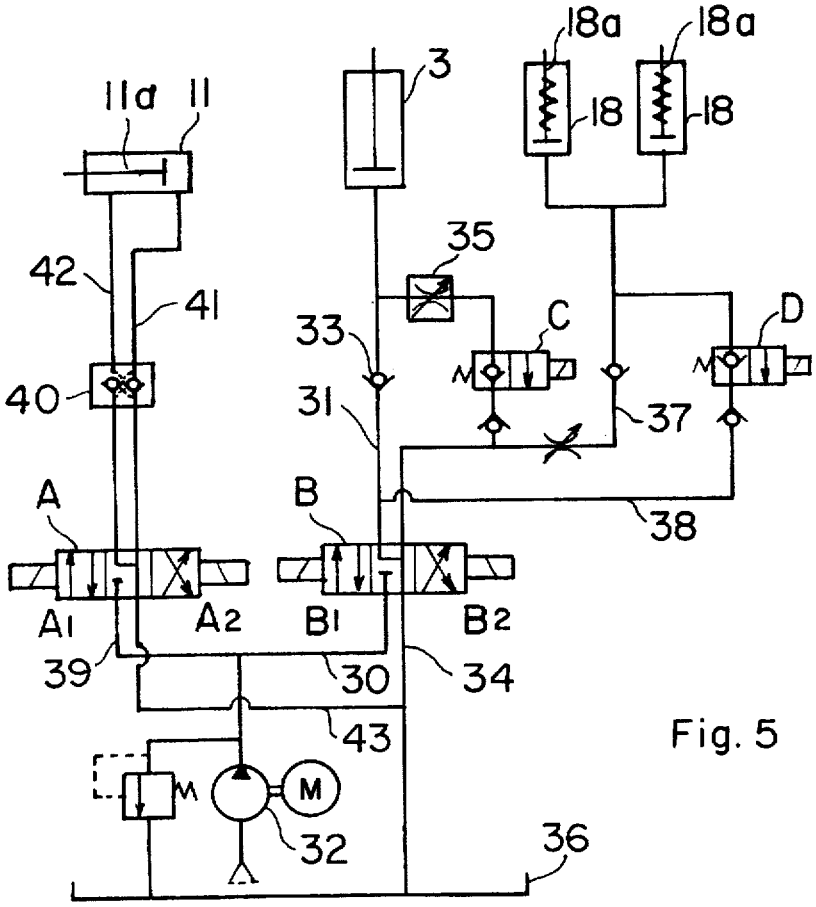
Fig. 5

LIFTING VEHICLE AND METHOD OF OPERATING THE VEHICLE

BACKGROUND OF THE INVENTION

1. Field of the Invention

The invention relates to a lifting vehicle.

2. Description of the Prior Art

One widely used type of lifting vehicle is the forklift. This kind of lifting vehicle includes a mount which carries tines that project to one side of the mount and are movable up-and-down. The mount is supported by a pair of wheeled bearing members which project to the same side of the mount as the tines and impart mobility to the forklift.

The tines are designed to lift pallets. The pallets generally include a pair of elongated laterally spaced legs which are bridged by an elevated platform for supporting goods. The space bounded by the platform and the legs can be closed by a panel at one or both ends thereof.

To lift a pallet, it is necessary to insert the tines beneath the platform. When the space under the platform is closed at one end, the gap below the platform at the other end is large enough to accept the wheeled bearing members of the forklift together with the tines. Thus, the pallet can be lifted even if the bearing members are fixed to the mount and cannot be shifted to positions laterally of the pallet. However, this is not the case where the space under the platform is closed by a panel at either end. Here, the panels block the wheeled members and the pallet cannot be lifted if the bearing members are fixed to the mount.

This problem can be avoided by designing the bearing members to be shiftable towards and away from one another. Such a design also allows the stability of the forklift to be adjusted when the forklift supports a load.

The Japanese Patent Publication No. 14479 discloses a forklift in which the rear end portions of two wheeled bearing members are connected to respective sections of a square pipe. The pipe sections are movable relative to one another so as to change the length of the pipe, and thus the distance between the bearing members. One of the pipe sections is provided with a rack which engages a pinion on the other of the pipe sections. The length of the pipe is changed by rotating the pinion via a handle.

It is difficult to adjust the distance between the bearing members of the Japanese Patent Publication No. 14479 because the handle is operated manually. Furthermore, the forks move with the bearing members during adjustment so that the distance between the bearing members cannot be changed when the forks support a pallet.

The Japanese Utility Model Provisional Publication No. 79794 teaches a forklift wherein the bearing members can be adjusted independently of the forks. The bearing members are provided with pipes which receive horizontal rods projecting laterally from the body of the forklift. The pipes can slide on the rods. Each of the pipes has a series of openings lengthwise, and the rods have projections which fit in the holes to fix the pipes in different positions on the rods.

A drawback of the forklift of the Japanese Utility Model Provisional Publication No. 79794 is that the bearing members must be adjusted separately. Moreover, to achieve proper balance, care must be exercised to position the bearing members at the same distance from the body of the forklift.

In the forklifts of both Japanese Publications, the front wheels of the bearing members rotate forwards and backwards but not sideways. Accordingly, when the bearing members are adjusted laterally, the front wheels will resist movement of the bearing members.

This problem can be overcome by using universal wheels such as casters for the front wheels. However, inasmuch as the rear wheels of the bearing members are usually universal wheels in order to permit steering, virtually all steering control would be lost if universal wheels were employed for the front wheels also.

SUMMARY OF THE INVENTION

It is an object of the invention to provide a lifting vehicle which enables the distance between bearing members to be adjusted relatively simply.

Another object of the invention is to provide a lifting vehicle which makes it possible, with little or no sacrifice in steering control, to vary the spacing between bearing members relatively smoothly.

An additional object of the invention is to provide a method which permits the distance between bearing members of a lifting vehicle to be changed in a relatively simple manner.

A further object of the invention is to provide a method which allows relatively smooth adjustment of the distance between bearing members of a lifting vehicle with little, if any, loss in steering ability.

The preceding objects, as well as others which will become apparent as the description proceeds, are achieved by the invention.

One aspect of the invention resides in a lifting vehicle. The vehicle comprises a mount, a lifting mechanism on the mount, and a pair of bearing members for moving the mount over a support surface. The bearing members project to one side of the mount, and each of the bearing members includes a first rolling element rotatable about a first axis and a second rolling element rotatable about a second axis transverse to the respective first axis. Each of the rolling elements has a lowered position in which the respective rolling element is arranged to contact the support surface and a raised position in which the respective rolling element is arranged to be out of contact with the support surface. Each of the bearing members further includes a displacing mechanism for moving the associated rolling elements between the raised and lowered positions. A shifting mechanism is provided to move the bearing members towards and away from one another, and the shifting mechanism is preferably designed to move the bearing members in synchronism.

Each displacing mechanism may be designed so that the associated first rolling element is moved to the lowered position in response to movement of the associated second rolling element to the raised position. Similarly, the displacing mechanisms may be designed to move the first rolling elements to the raised positions in response to movement of the second rolling elements to the lowered positions. The lifting vehicle can further comprise an actuator which actuates the displacing mechanisms in such a manner that the first rolling elements assume the raised and lowered positions together and the second rolling elements assume the raised and lowered positions together.

The first rolling elements may be rotatable about axes which are normal to the direction of travel of the lifting vehicle while the second rolling elements may be rotatable about axes which are parallel to the direction of travel. In other words, the first rolling elements may be arranged to rotate backwards and forwards whereas the second rolling elements may be arranged to rotate sideways. When the first rolling elements are in contact with a support surface and the second rolling elements are out of contact with the surface, the vehicle can then transport loads in the same way as a conventional lifting vehicle without loss of steering control. On the other hand, when the second rolling elements engage the support surface and the first rolling elements are out of engagement with the surface, the bearing members are able to move smoothly sideways towards and away from one another.

The mechanism for shifting the bearing members towards and away from each other can include a first carrier which is fast with one of the bearing members and a second carrier which is fast with the other of the bearing members. The carriers can, for example, be constituted by a pair of parallel rails. The rails may be connected to one another by a rack-and-pinion mechanism, and an actuator may be in engagement with and arranged to move one of the rails. When the actuator is operated to move this rail, the movement will be transmitted to the second rail via the rack-and-pinion mechanism so that the rails are displaced synchronously. Consequently, the lifting vehicle maintains proper balance as the bearing members are shifted towards and away from one another.

Another aspect of the invention resides in a method of operating a lifting vehicle stationed on a support surface. The method comprises the steps of lowering first portions of the vehicle into contact with the support surface, raising second portions of the vehicle from contact with the support surface, and shifting first and second parts of the vehicle towards or away from one another on the first portions. The raising step can be performed in response to the lowering step.

The method may further comprise the steps of raising the first portions from contact with the support surface, lowering the second portions into contact with the support surface, and displacing the vehicle on the second portions. Here, the lowering step can be carried out in response to the raising step.

The shifting step preferably involves shifting the first and second parts in substantial synchronism.

Additional features and advantages of the invention will be forthcoming from the following detailed description of preferred embodiments when read in conjunction with the accompanying drawings.

BRIEF DESCRIPTION OF THE DRAWINGS

FIG. 4A is a fragmentary, partly sectional side view showing a pair of wheels of the lifting vehicle of FIG. 1 in one position.

FIG. 4B is similar to FIG. 4A but shows the wheels in another position.

FIG. 5 is a schematic of a hydraulic circuit constituting part of the lifting vehicle of FIG. 1.

DESCRIPTION OF THE PREFERRED EMBODIMENTS

Figure 1:
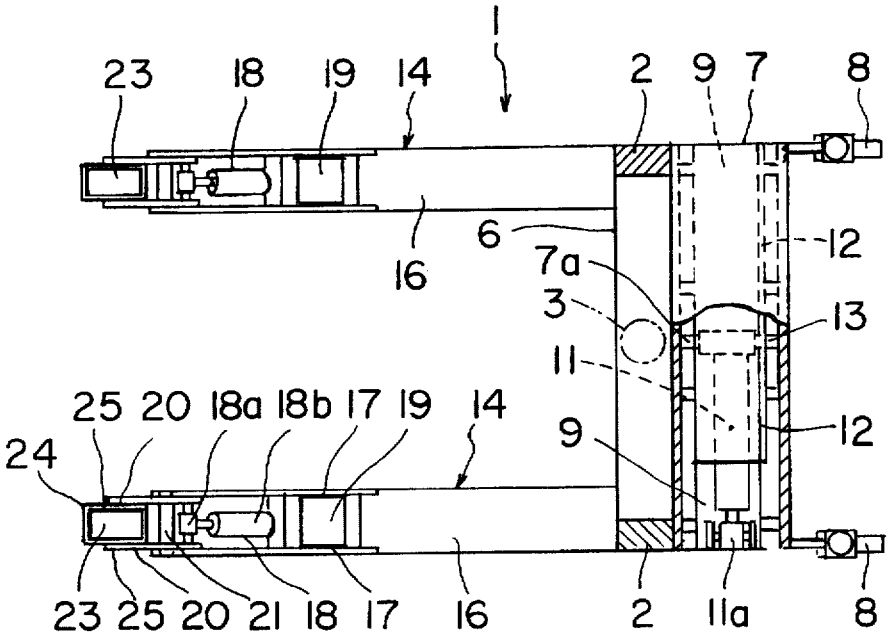
FIG. 1 is a plan view of a lifting vehicle in accordance with the invention.
Figure 2:
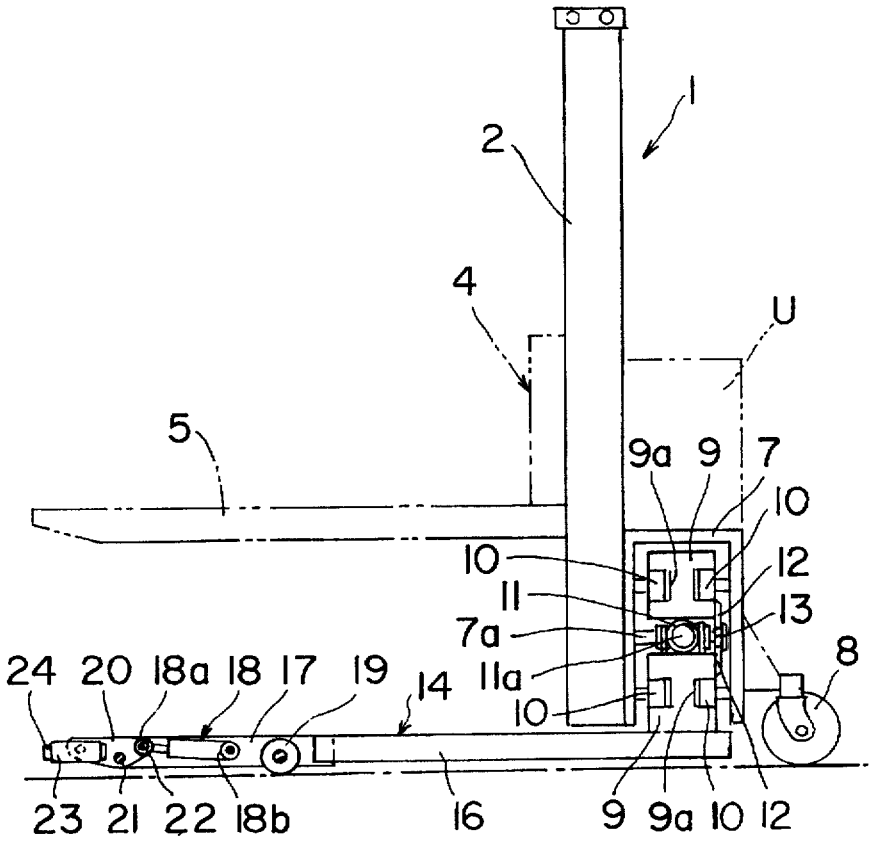
FIG. 2 is a side view of the lifting vehicle of FIG. 1.

Referring to FIGS. 1 and 2, the numeral 1 generally identifies a lifting vehicle according to the invention. The lifting vehicle 1 is a forklift and includes a pair of spaced columns 2 which carry, and serve as a mount or guide for, a lifting mechanism. The lifting mechanism includes a carrier or support 4 which is movable up-and-down on the columns 2. The lifting mechanism further includes a fork made up of two tines or prongs 5 which are mounted on the carrier 4 and project to one side of the columns 2 (to the left of the columns 2 as seen in FIGS. 1 and 2).

The lower ends of the columns 2 are bridged by a beam or support 6. A hydraulic piston-and-cylinder unit 3 is positioned upright on the beam 6 and functions to operate the carrier 4. The unit 3 is connected to the carrier 4 by way of a sprocket, and a chain which is secured to one end of the piston rod of the unit 3.

In the following description, the side of the forklift 1 with the tines 5 will be considered the front of the forklift 1. The right and left sides of the forklift 1 are the respective sides of the forklift 1 when standing behind and facing the forklift 1.

A cover 7 is fixed to the backs of the columns 2. The cover 7 has a front wall and a rear wall as well as a top wall which spans the front and rear walls. The cover 7 thus defines a compartment which is closed at the front, the rear and the top and is open at the sides and the bottom. A pair of wheels or rolling elements 8 is mounted on the rear wall of the cover 7, and the wheels 8 are arranged to swivel on a vertical axis to allow steering of the forklift 1. The wheels 8 are here in the form of casters.

Two rails 9 are horizontally disposed in the compartment defined by the cover 7. The rails 9, which extend laterally of the forklift 1, are situated at different levels and overlap one another. The rails 9 have I-shaped sections, and a longitudinal groove 9*a* is defined on either side of each rail 9. Each of the grooves 9*a* receives a runner or roller 10, and the runners 10 allow the rails 9 to move laterally of the forklift 1. Two runners 10 are mounted on the front wall of the cover 7 and two runners 10 on the rear wall.

A double-acting, hydraulic piston-and-cylinder unit 11 is located in the compartment defined by the cover 7 and is disposed at a level between the rails 9. The unit 11 is horizontally oriented and extends laterally of the forklift 1. The right end of the cylinder of the unit 11 is situated at or near the middle of the compartment defined by the cover 7 and is fixed to the front and rear walls of the cover 7 by a shaft 7*a*. The left end of the cylinder faces the left end of the lower rail 9, namely, that end of the lower rail 9 which is directed away from the upper rail 9. A piston rod 11*a* extends from the left end of the cylinder and is provided with a head which is secured to the left end of the lower rail 9.

Figure 3A:
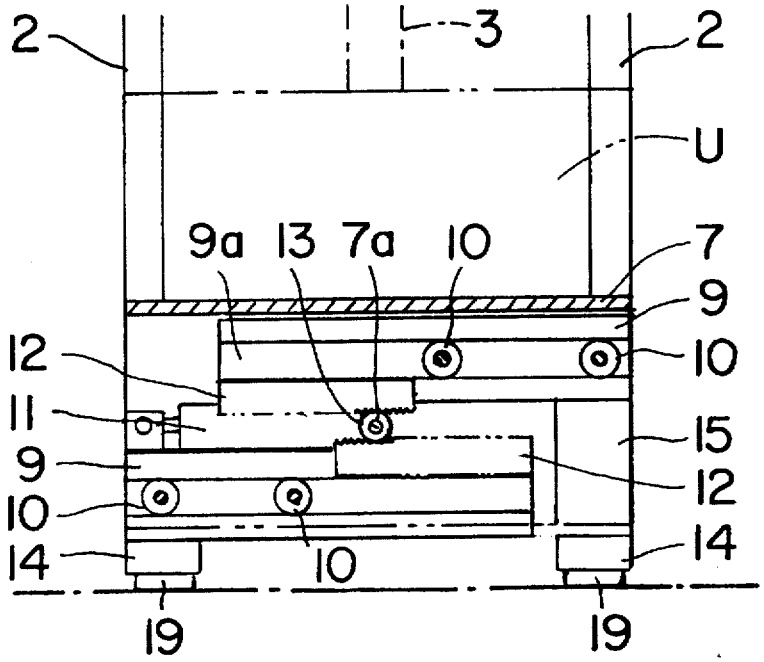
FIG. 3A is a partly sectional rear view of the lifting vehicle of FIG. 1 showing wheeled bearing members of the vehicle in one position.
Figure 3B:
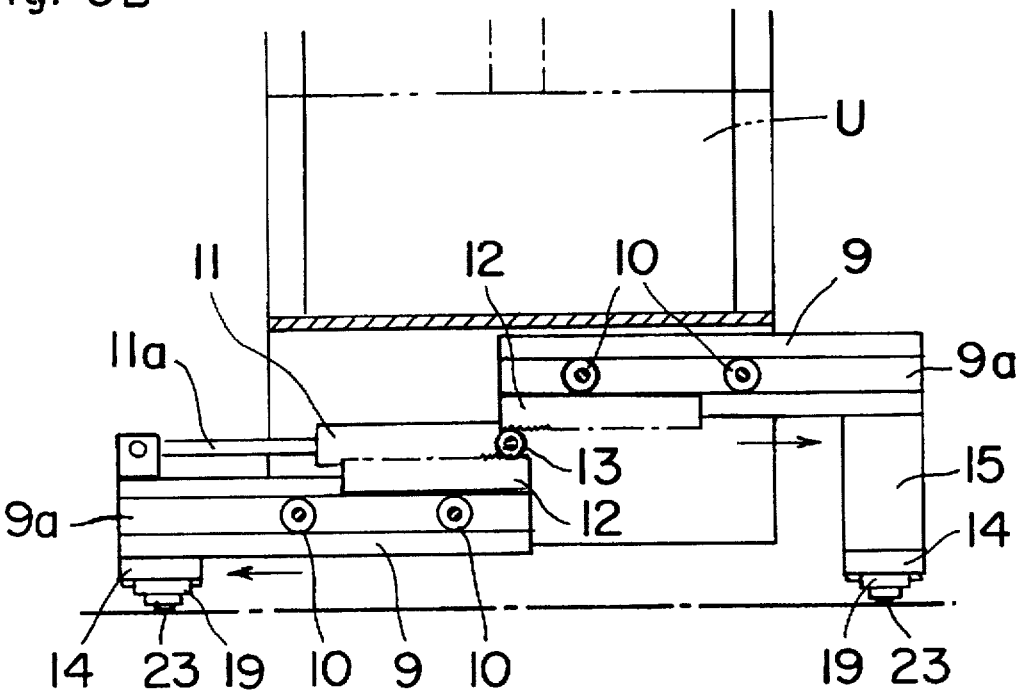
FIG. 3B is similar to FIG. 3A but shows the wheeled bearing members in another position.

Considering FIGS. 3A and 3B in conjunction with FIGS. 1 and 2, the bottom surface of the upper rail 9 and the top surface of the lower rail 9 are each formed with a rack 12. The racks 12 face one another, and a pinion 13 is disposed between and meshes with the racks 12. The pinion 13 is mounted on the shaft 7*a* which fixes the cylinder of the piston-and-cylinder unit 11 to the front and rear walls of the cover 7.

In FIG. 3A, the piston rod 11*a* of the piston-and-cylinder unit 11 is retracted. Both rails 9 are likewise retracted and are located within the confines of the compartment defined by the cover 7. When the piston rod 11*a* is extended per FIG. 3B, the lower rail 9 is shifted to the left and protrudes through the open left side of the compartment. Due to the rack-and-pinion mechanism 12,13 connecting the rails 9 to each other, the upper rail 9 is shifted in synchronism with, but in a direction opposite to, the lower rail 9. Thus, in response to movement of the lower rail 9 to the left, the upper rail 9 moves to the right so as to project through the open right side of the compartment defined by the cover 7.

The left end of the lower guide rail 9 sits directly on and is secured to the rear end of an elongated bearing or carrying member 14. On the other hand, the right end of the upper guide rail 9 is seated on and connected to a pedestal 15 which, in turn, sits directly on and is secured to the rear end of a second elongated bearing or carrying member 14. The bearing members 14 are parallel to, and extend beyond the front of the columns 2 for approximately the same distance as, the tines 5. The bearing members 14 also project slightly to the rear of the rails 9.

The bearing members 14 have the same structure, and the structure of the left bearing member 14 will be described with reference to FIGS. 1, 2, 4A and 4B.

The bearing member 14 includes a main section 16 which is fast with the lower guide rail 9 and projects to the front of the columns 2. A rectangular plate 17 is mounted on either side of the front end of the beam 16. The side plates 17, which are disposed in vertical planes and are parallel to each other, extend lengthwise beyond the beam 16 and form an extension thereof. A wheel or rolling element 19, which will be referred to as a primary wheel for ease of description, is mounted between the side plates 17 for rotation about an axis normal to the bearing member 14. Thus, the primary wheel 19 is arranged to roll forwards and backwards.

An hydraulic piston-and-cylinder unit 18 is also located between the side plates 17. The unit 18 is located in front of the primary wheel 19 and extends generally longitudinally of the bearing member 14. The unit 18 includes a cylinder **18*b*, and the rear end of the cylinder 18*b* is connected to the side plates 17. A piston rod 18*a* provided with a head protrudes from the front end of the cylinder 18*b***.

A pair of laterally spaced, approximately triangular arms 20 is situated in front of the piston-and-cylinder unit 18 at the forward ends of the side plates 17. The rear portions of the arms 20 are disposed between the side plates 17 while the front portions of the arms 20 project beyond the side plates 17. The rear portion of each arm 20 comprises two apices, and the arms 20 are arranged so that one apex is located below and in front of the other. The lower apices are pivotable on a shaft 21 which is carried by the side plates 17. The upper apices are connected to one another by a shaft 22, and the piston rod head of the piston-and-cylinder unit 18 is pivotally mounted on the shaft 22 between the arms 20. Accordingly, the arms 20 will pivot on the shaft 21 as the piston rod **18*a* of the unit 18** is extended and retracted.

A rectangular frame or holder 24 is disposed between the protruding front portions of the arms 20 and is held on the arms 20 by pins 25. The frame 24 extends lengthwise of the bearing member 14 and is oriented so that the four sides thereof are located in vertical planes. A wheel or rolling element 23, which will be referred to as a secondary wheel for ease of description, is mounted inside the frame 24 for rotation about an axis parallel to the bearing member 14. Thus, the secondary wheel 23, which resembles a roller, is arranged to roll sideways.

When the piston rod **18*a* of the piston-and-cylinder unit 18 is retracted, the primary wheel 19 contacts the surface on which the forklift 1 is stationed whereas the secondary wheel 23 is held in a raised position out of contact with the surface. This is shown in FIG. 4A. On the other hand, when the piston rod 18*a* is extended as in FIG. 4B, the secondary wheel 23 engages the surface on which the forklift 1 is positioned while the primary wheel 19 is in a raised position free of contact with the surface. The arrangement is such that the primary wheel 19 is raised in response to lowering of the secondary wheel 23 and is lowered in response to raising of the secondary wheel 23**.

An hydraulic unit U containing a battery sits atop the cover 7. The hydraulic unit U serves to actuate the piston-and-cylinder units 3, 11 and 18 and, to this end, is provided with a non-illustrated operator's panel.

The operation of the forklift 1 will be described with reference to FIG. 5 which illustrates the hydraulic circuit of the forklift 1. It is assumed that the forklift 1 is initially in the condition of FIG. 3A where the piston rod **11*a* of the piston-and-cylinder unit 11, and also the rails 9, are retracted. The lower rail 9 is in its extreme right-hand position while the upper rail 9 is in its extreme left-hand position, and both rails 9 are confined within the cover 7. The primary wheels 19 are in contact with the surface on which the forklift 1 is stationed and the secondary wheels 23** are out of contact with the surface. Such surface will be referred to as the ground in the following description.

When the rails 9 are in the positions of FIG. 3A, the bearing members 14 are directly underneath the tines 5. If, as is further assumed here, the carrier 4 is in its lowest position, the tines 5 are at almost the same level as and cover the bearing members 14. In this condition, the forklift 1 can pick up and carry pallets which are closed by a panel at one end but not the other.

Referring to FIG. 5, if the tines 5 have been inserted beneath a pallet and the pallet is to be raised, the operator of the forklift 1 presses a "raise" button on the operator's panel. This actuates the motor M of a pump 32 and causes a valve element B1 of a switching valve B to connect a branch 30 of a discharge pipe for the pump 32 with a feed pipe 31 for the piston-and-cylinder unit 3. The feed pipe 31 is provided with a check valve 33. Pressurized hydraulic fluid, e.g., oil, delivered by the pump 32 pushes the piston rod of the unit 3 upward thereby raising the carrier 4 together with the tines 5 and the pallet. When the operator presses a "lower" button, a flow passage in a switching valve C establishes a connection between the unit 3 and an outflow pipe 34. The carrier 4 then descends by gravity and forces hydraulic fluid out of the unit 3. The hydraulic fluid flows into a tank or reservoir 36 via a flow control valve 35, the switching valve C and the outflow pipe 34. A check valve is disposed immediately downstream of the switching valve C.

In the condition of FIG. 3A, the forklift 1 is unable to lift pallets which are closed by a panel at both ends because the bearing members 14 do not fit below the panels. To lift a panel of this type, the carrier 4 is raised as described above to move the tines 5 away from the bearing members 14. The operator then actuates an extending switch provided on the operator's panel for the piston-and-cylinder units 18. The switching valve B is thereupon moved to a position in which a valve element B2 of the switching valve B connects the branch 30 of the pump discharge pipe with a feed pipe 37 for the two piston-and-cylinder units 18. The feed pipe 37 contains a check valve. The pump 32 now pumps hydraulic fluid to the units 18 via the pipe branch 30 and the feed pipe 37. The pressurized hydraulic fluid supplied by the pump 32 moves the piston rods **18*a* of the units 18 to their extended positions. As a result, the arms 20 pivot counterclockwise as viewed in FIG. 4A to bring the secondary wheels 23 into contact with, and raise the primary wheels 19 from, the ground. This condition is shown in FIG. 4B. In such condition, the forklift 1 is supported by the casters 8 at the rear and the secondary wheels 23** at the front.

Once the primary wheels 19 have been raised and the secondary wheels 23 lowered, the extending switch for the piston-and-cylinder units 18 is turned off and the switching valve B shifts to a neutral position. The operator next moves a switch for the piston-and-cylinder unit 11 from a neutral position to an "extend" position. This causes a flow passage in a valve element A2 of a switching valve A to connect a second branch 39 of the pump discharge pipe with a supply/discharge pipe 41 for the unit 11. The supply/discharge pipe 41 is provided with a check valve constituting part of a valve unit 40.

As viewed in FIG. 5, the cylinder of the piston-and-cylinder unit 11 has a first chamber to the right of its piston and a second chamber to the left of its piston. The supply/discharge pipe 41 communicates with the right chamber, and pressurized hydraulic fluid from the pump 32 thus enters the unit 11 to the right of its piston. The piston is thus pushed to the left and moves the piston rod 11*a* of the unit 11 to the extended position.

Since the unit 11 is a double-acting piston-and-cylinder unit, hydraulic fluid is expelled from the left chamber of the unit 11 as the piston moves to the left. The expelled hydraulic fluid leaves the left chamber via a discharge/supply pipe 42 which, by way of a second flow passage in the valve element A2, is in communication with a connecting pipe 43 bridging the discharge/supply pipe 42 and the outflow pipe 34. The discharge/supply pipe 42 contains a check valve forming part of the valve unit 40. From the discharge/supply pipe 42, the expelled hydraulic fluid flows through the switching valve A, the connecting pipe 43 and the outflow pipe 34 into the tank 36.

As the piston rod 11*a* of the piston-and-cylinder unit 11 extends, the lower rail 9 travels to the left from the position of FIG. 3A. The rack 12 on the lower rail 9 rotates the pinion 13 which, in turn, exerts a force on the rack 12 of the upper rail 9 thereby causing the upper rail 9 to move in synchronism with the lower rail 9. However, the force transmitted to the upper rail 9 acts in a sense opposite to the force on the lower rail 9 so that the upper rail 9 travels to the right from the position of FIG. 3A, i.e., travels in a direction opposite to the lower rail 9. Since the secondary wheels 23, which are arranged to roll sideways, are in contact with the ground while the primary wheels 19 are out of contact, the bearing members 14 ride smoothly sideways with the rails 9. The distance between the bearing members 14 is thus increased as is apparent from FIG. 3B.

When the distance between the bearing members 14 exceeds the width of the pallets which are closed at both ends, the switch for the piston-and-cylinder unit 11 is moved back to its neutral position. In response, the switching valve A shifts to a neutral position and the pump 32 is switched off to discontinue extension of the piston rod 11*a* of the unit 11. The operator thereupon turns on a retracting switch for the piston-and-cylinder units 18. This causes a flow passage in a switching valve D to establish communication between the units 18 and an outlet pipe 38 containing a check valve. The outlet pipe 38 opens into the feed pipe 31 between the check valve 33 and the switching valve B which is in the neutral position and connects the feed pipe 31 with the outflow pipe 34. The piston rods 18*a* of the units 18 retract under the action of springs installed in the units 18, and this is accompanied by expulsion of hydraulic fluid from the units 18. The expulsed hydraulic fluid flows through the switching valve D, the outlet pipe 38, the feed pipe 31, the switching valve B and the outflow pipe 34 into the tank 36. As the piston rods 18*a* of the unit 18 retract, the arms 20 rotate clockwise as viewed in FIG. 4B thereby raising the secondary wheels 23 and allowing the primary wheels 19 to descend into contact with the ground. Since the bearing members 14 now fit around the pallets which are closed at either end by a panel, they no longer interfere with insertion of the tines 5 into the pallets so that the forklift 1 can pick up and carry the pallets.

When the distance between the bearing members 14 is to be reduced, the extending switch for the piston-and-cylinder units 18 is switched on to lower the secondary wheels 23 and raise the primary wheels 19 as described previously. The switch for the piston-and-cylinder unit 11 is then moved to a "retract" position which causes the switching valve B to shift to its neutral position. Furthermore, the switching valve A is moved to a position in which a valve element A1 of the switching valve A establishes communication between the discharge/supply pipe 42 and the branch 39 of the pump discharge pipe, and also between the supply/discharge pipe 41 and the connecting pipe 43. Pressurized hydraulic fluid is pumped into the left chamber of the unit 11 by the pump 32 thereby forcing the piston of the unit 11 to the right so that the piston rod 11*a* of the unit 11 is retracted. As the piston of the unit 11 moves to the right, hydraulic fluid is expelled from the right chamber of the unit 11. The expelled hydraulic fluid flows through the supply/discharge pipe 41, the connecting pipe 43 and the outflow pipe 34 into the tank 36. The rails 9 are retracted into the cover 7 in response to retraction of the piston rod 11*a* thus reducing the distance between the bearing members 14.

In the forklift 1, the distance between the bearing members 14 is changed by automatically displacing the bearing members 14 in synchronism. Since the distance between the bearing members 14 is variable, the forklift 1 can be used for pallets which are closed at both ends as well as for pallets which are closed at one end only. Moreover, inasmuch as the primary wheels 19 which rotate backward and forward are used for driving whereas the secondary wheels 23 which rotate sideways are used for shifting the bearing members 14, the bearing members 14 can be moved towards and away from each other smoothly without affecting the steerability of the forklift 1. In addition, it is possible to shift the bearing members 14 while the tines 5 support a load. Thus, when the bearing members 14 have been spread apart in order to allow the tines 5 to lift a load, the distance between the bearing members 14 can be reduced once the load has been raised in order to permit the forklift 1 to pass through a narrow aisle.

Due to the fact that the bearing members 14 are connected to the rails 9 which move synchronously, the forklift 1 is automatically well-balanced as the bearing members 14 move towards and away from one another and the bearing members 14 can be easily shifted.

In the illustrated embodiment, the piston-and-cylinder unit 18 for raising and lowering the wheels 19,23 is designed to be operated independently of the piston-and-cylinder unit 11 for extending and retracting the rails 9. Accordingly, the position of the tines 5 relative to a load can be easily adjusted by lowering the secondary wheels 23 through operation of the unit 18 alone and then moving the forklift 1 sideways. The forklift 1 is also capable of operating effectively in small spaces because the secondary wheels 23 can be used to move sideways and to turn.

The secondary wheels 23 are here shown as being disposed in front of the primary wheels 19. However, the secondary wheels 23 can be located behind the primary wheels 19 as long as the forklift 1 has sufficient stability when the secondary wheels 23 are lowered and the primary wheels 19 are raised. Furthermore, the structures of the wheels 19,23 and the manner of mounting the latter are not limited to the showing in the drawings and can be modified in a wide variety of fashions. For example, a primary wheel 19 and a corresponding secondary wheel 23 can be affixed to opposite ends of an arm which, similarly to a seesaw, is pivotally supported at its center by a shaft. By pivoting the arm, one of the wheels 19,23 can then be brought into contact with the ground while the other wheel 23,19 is lifted from the ground.

The rails 9 can be arranged in parallel side-by-side instead of one above the other, and the racks 12 and pinion 13 can again be used in such an arrangement to move the rails 9 in synchronism. It is further possible to replace the racks 12 and pinion 13 with other mechanisms for achieving synchronous movements.

As mentioned earlier, the hydraulic circuit of the forklift 1 is designed so that the piston-and-cylinder unit 11 can be operated independently of the piston-and-cylinder unit 18. However, this is not necessary and the hydraulic circuit can be constructed in such a manner that a single switch initiates a sequence in which the secondary wheels 23 are lowered, the bearing members 14 shifted and the primary wheels 19 lowered. Additionally, pneumatic piston-and-cylinder units may be employed instead of hydraulic piston-and-cylinder units, and the piston-and-cylinder units can be operated manually by a pumping handle rather than by a battery.

Various other modifications are possible within the meaning and range of equivalence of the appended claims.

I claim:

1. A lifting vehicle, comprising a mount; a lifting mechanism on said mount; a pair of bearing members for moving said mount over a support surface, said bearing members projecting to one side of said mount, and each of said bearing members including a first rolling element rotatable about a first axis and a second rolling element rotatable about a second axis transverse to the respective first axis, each of said rolling elements having a lowered position in which the respective rolling element is arranged to contact the support surface and a raised position in which the respective rolling element is arranged to be out of contact with the support surface, and each of said bearing members further including a displacing mechanism for moving the associated rolling elements between the raised and lowered positions; and a shifting mechanism for moving said bearing members towards and away from one another.

2. The vehicle of claim 1, wherein said bearing members are elongated and substantially parallel to one another.

3. The vehicle of claim 1, wherein said shifting mechanism is designed to move said bearing members synchronously.

4. The vehicle of claim 3, wherein said shifting mechanism comprises a first carrier fast with one of said bearing members, a second carrier fast with the other of said bearing members, and a rack-and-pinion mechanism connecting said carriers to one another.

5. The vehicle of claim 4, wherein said rack-and-pinion mechanism comprises a rack on each of said carriers, and a pinion in engagement with said racks.

6. The vehicle of claim 4, wherein each of said carriers comprises a rail and said rails are substantially parallel to one another.

7. The vehicle of claim 4, further comprising an actuator connected to and arranged to move one of said carriers.

8. A lifting vehicle, comprising a mount; a lifting mechanism on said mount; a pair of bearing members for moving said mount over a support surface, said bearing members projecting to one side of said mount, and each of said bearing members including a first rolling element rotatable about a first axis and a second rolling element rotatable about a second axis transverse to the respective first axis, each of said rolling elements having a lowered position in which the respective rolling element is arranged to contact the support surface and a raised position in which the respective rolling element is arranged to be out of contact with the support surface, and each of said bearing members further including a displacing mechanism for moving the associated rolling elements between the raised and lowered positions, each of said displacing mechanisms being designed so that the associated first rolling element is moved to the lowered position in response to movement of the corresponding second rolling element to the raised position and the associated first rolling element is moved to the raised position in response to movement of the corresponding second rolling element to the lowered position; and a shifting mechanism for moving said bearing members towards and away from one another.

9. A lifting vehicle, comprising a mount; a lifting mechanism on said mount; a pair of bearing members for moving said mount over a support surface, said bearing members projecting to one side of said mount, and each of said bearing members including a first rolling element rotatable about a first axis and a second rolling element rotatable about a second axis transverse to the respective first axis, each of said rolling elements having a lowered position in which the respective rolling element is arranged to contact the support surface and a raised position in which the respective rolling element is arranged to be out of contact with the support surface, and each of said bearing members further including a displacing mechanism for moving the associated rolling elements between the raised and lowered positions; an actuator for actuating said displacing mechanisms in such a manner that said first rolling elements assume the raised and lowered positions together and said second rolling elements assume the raised and lowered positions together; and a shifting mechanism for moving said bearing members towards and away from one another.

* * * * *